US006234660B1

(12) United States Patent
Hullmann et al.

(10) Patent No.: US 6,234,660 B1
(45) Date of Patent: May 22, 2001

(54) METHOD FOR THE PRODUCTION OF AN INTERMEDIATE PRODUCT WHICH CAN BE INJECTION MOULDED

(75) Inventors: Hans-Dieter Hullmann, Bergisch Gladbach; Ulrich Schaer; Ludger Schuermann, both of Paderborn; Burkhard Wulf, Brakel, all of (DE)

(73) Assignee: Gebrueder Loedige Maschinen-gesellschaft mit beschraenkter Haftung, Paderborn (DE)

( * ) Notice: Subject to any disclaimer, the term of this patent is extended or adjusted under 35 U.S.C. 154(b) by 0 days.

(21) Appl. No.: 09/293,966

(22) Filed: Apr. 19, 1999

(30) Foreign Application Priority Data

May 12, 1998 (DE) ..... 198 21 072

(51) Int. Cl.[7] ..... B01F 7/00

(52) U.S. Cl. ..... 366/98; 366/241; 366/348; 366/144

(58) Field of Search ..... 366/2, 4, 7, 23, 366/24, 144, 147, 148, 149, 96, 97, 98, 241, 279, 348

(56) References Cited

U.S. PATENT DOCUMENTS 4,057,227 * 11/1977 Cruff et al. ..... 366/2
4,197,118 * 4/1980 Wiech, Jr. ..... 75/228
4,228,116 * 10/1980 Colombo et al. .
5,083,871 * 1/1992 Neil et al. ..... 366/69
5,401,292 * 3/1995 Japka .
5,620,642 * 4/1997 Kamite et al. ..... 264/115
5,637,836 * 6/1997 Nakagawa et al. ..... 366/151.1
5,678,165 * 10/1997 Wu ..... 419/37
5,746,957 * 5/1998 Fanelli et al. .

FOREIGN PATENT DOCUMENTS

381415 * 10/1964 (CH) .
139 543 * 1/1980 (DD) .
29 27 053 * 1/1981 (DE) .
36 11 271 A1 * 1/1987 (DE) .
0 655 310 A1 * 9/1994 (EP) .
0 688 746 A1 * 12/1995 (EP) .
0 764 616 A1 * 3/1997 (EP) .
59-241844 * 6/1986 (JP) .

* cited by examiner

*Primary Examiner*—Tony G. Soohoo
(74) *Attorney, Agent, or Firm*—Paul Vincent

(57) ABSTRACT

A method for the production of an intermediate product which can be injection moulded, from a dry, pasty or fluid raw material and at least one binding agent can be carried out in a mixing container (4). The raw materials and the at least one binding agent can be initially processed into a pourable powder mixture using rapidly rotating mixing elements (18, 18', 8", 18''') which is subsequently warmed and processed into the intermediate product with the assistance of mechanical processing of the powder mixture by the mixing elements (18 through 18''') and/or additional components. The method facilitates as effective a manufacture as possible of a high quality intermediate product, in a substantially reduced processing time, which can be injection-moulded.

2 Claims, 2 Drawing Sheets

METHOD FOR THE PRODUCTION OF AN INTERMEDIATE PRODUCT WHICH CAN BE INJECTION MOULDED

This application claims Paris Convention priority of German patent application number 198 21 072.8 filed May 12, 1998, the complete disclosure of which is hereby incorporated by reference.

BACKGROUND OF THE INVENTION

The present invention concerns a method for the Production of an intermediate product, which can be inject-on moulded, from a dry, pasty or fluid raw material and at least one binding agent.

Known in the art is the production of intermediate products, which can be injection moulded, by kneading of raw materials together with a binding agent in a device.

In the conventional methods, the raw materials are processed together with the binding agent within the device (kneading device) with the assistance of knead elements, warmed by a separate heating device and kneaded into a paste after melting of the binding agent. The paste can then be removed from the device, and the extracted intermediate product, designated as "feedstock" (paste), can be injection moulded into a product to be produced. This object must still be subjected to baking or sintering processing for curing and is referred to as a "green body". The intermediate product must optionally be further processed prior to injection moulding. This further processing can consist essentially of a granulation or a grinding of the cooled paste.

In order to manufacture the intermediate product, it is necessary for the raw materials and the binding agent to disadvantageously be kneaded for 2 to 20 hours.

Due to the low mixing effectivity of the kneading device, the produced paste has a limited degree of homogeneity. This low or absent homogeneity affects the recycling process or the utilization of the waste products occurring from injection moulding which are once more introduced into the device. It has turned out that there is a strong difference in flow properties between the pure raw materials and the recycled product wastes. The inadequate homogeneity of the paste also leads to the need for post-processing the paste optionally in an extruder or in a cylinder mill.

The kneading processing of a mixture comprising raw materials and at least one binding agent is only possible in dependence on the mixture utilized by selecting an appropriate mixture. Not all types of kneading devices are suitable for each mixture so that, under certain circumstances, the mixture must be changed.

It is the purpose of the present invention to develop a method for as effective production as possible of a high quality intermediate product which can be injection moulded.

SUMMARY OF THE INVENTION

This purpose is achieved by a method with which the raw material and the at least one binding agent are initially processed in a mixing container using rapidly rotating mixing elements to generate a powder mixture and, subsequent thereto and with the assistance of mechanical processing of the powder mixture by the mixing elements and/or of additional components (break-up tools, rod-shaped elements, knives, etc.), the powder mixture is warmed and processed into the intermediate product.

The designation—rapidly rotating mixing elements—refers to a motion of the mixing elements which is capable of producing a swirl or a circulating ring of mixed products within the device. The mixing elements should have a peripheral velocity in excess of 20 m per second.

The components of the mixture are introduced into the mixing container either simultaneously or sequentially. Processing of the mixing components with the assistance of the mixing elements generates frictional heat to warm up the mixing components. In exceptional cases, the heating-up process can be supported or initiated by heating-up the wall of the mixing container. During this processing step, an intense pre-mixing of the raw material and the binding agent occurs. A pourable powder mixture having high mixing quality normally results.

In the same mixing container, an intermediate product in the form of an agglomerate or a paste can be generated from the powder mixture which can be extruded in a mold to generate an object. Both the agglomerate as well as the paste have high homogeneity. This mixing quality improves the quality of the final product which can be produced from the intermediate product.

Mixing elements disposed on a rapidly rotating mixing shaft facilitate limitation of the processing duration, in most cases, to 10 to 20 minutes.

Processing of the raw material and the binding agent in the device with the assistance of the rapidly rotating mixing elements can be carried out independent of the mixture of raw materials and binding agent introduced into the device. A rate of rotation of the mixing shaft adapted to the mixture can be adjusted in such a fashion by controlling the device that the desired pre-mixture and heating-up of the mixture occurs. The mixing elements can cooperate with fixed or movable components in the mixing region to shorten the mixing and/or breaking-up and warming times.

The method in accordance with the invention advantageously leads to a reduction in the investment and operating costs and has positive effects on the lifetime of operation of the device for carrying out the method.

In a preferred embodiment, the mixture comprising the raw material and at least one binding agent is heated and agglomerated through mechanical processing to below the melting point of the binding agent. The frictional heat occurring in the vicinity of the mixing elements leads to a melting of the surfaces of the binding agent particles which can then bond to the raw material particles to effect agglomerate generation. For certain mixture conditions, the agglomerate can already be removed from the device as an intermediate product capable of injection moulding.

In another embodiment, the binding agent is melted through the mechanical processing in the mixing container, wherein a paste is produced from the mixture comprising the raw materials and the at least one binding agent. The raw material particles form, together with the binding agent particles, a viscous mass of pasty consistency. The binding-together of the raw material particles and the binding agent particles leads to an intermediate product which can flow. The ductile paste is likewise highly homogenized through processing by the mixing elements.

The paste can be cooled down and thereby once more agglomerated prior to further processing of the agglomerate using an injection moulding machine.

Bulk products, solids as well as fluid raw materials of the most differing kinds can be utilized as raw materials. The method can also be used with metallic powder or ceramic powder as raw materials. The method can thereby be utilized for the production of intermediate products suitable for powder-injection moulding (PIM) technology. A modified plastic injection moulded machine thereby produces the "greenhorn" out of a raw material powder and binding agent mixture. The extruded and cured "greenhorn" can then be further processed in differing manners.

An organic binding agent can preferentially be utilized as at least one binding agent. Binding agents can be considered which react with the raw materials and/or which can accelerate the combining of the raw material particles among themselves. The organic binding agent can effect sufficient flow capability in the injection moulding machine and can impart a large degree of shape stability to the extruded and cured slug (greenhorn). The binding agent can be removed from the greenhorn using baking or sintering methods.

The method in accordance with the invention is simultaneously applicable for MIM (metal injection moulding) and CIM (ceramic injection moulding).

Further features and advantages of the invention can be extracted from the subsequent description of an embodiment of the invention with regard to the drawing, showing details important to the invention, and from the claims. The individual features can be utilized in embodiments of the invention individually or collectively in arbitrary combination.

DESCRIPTION OF THE PREFERRED EMBODIMENT

Figure 1:
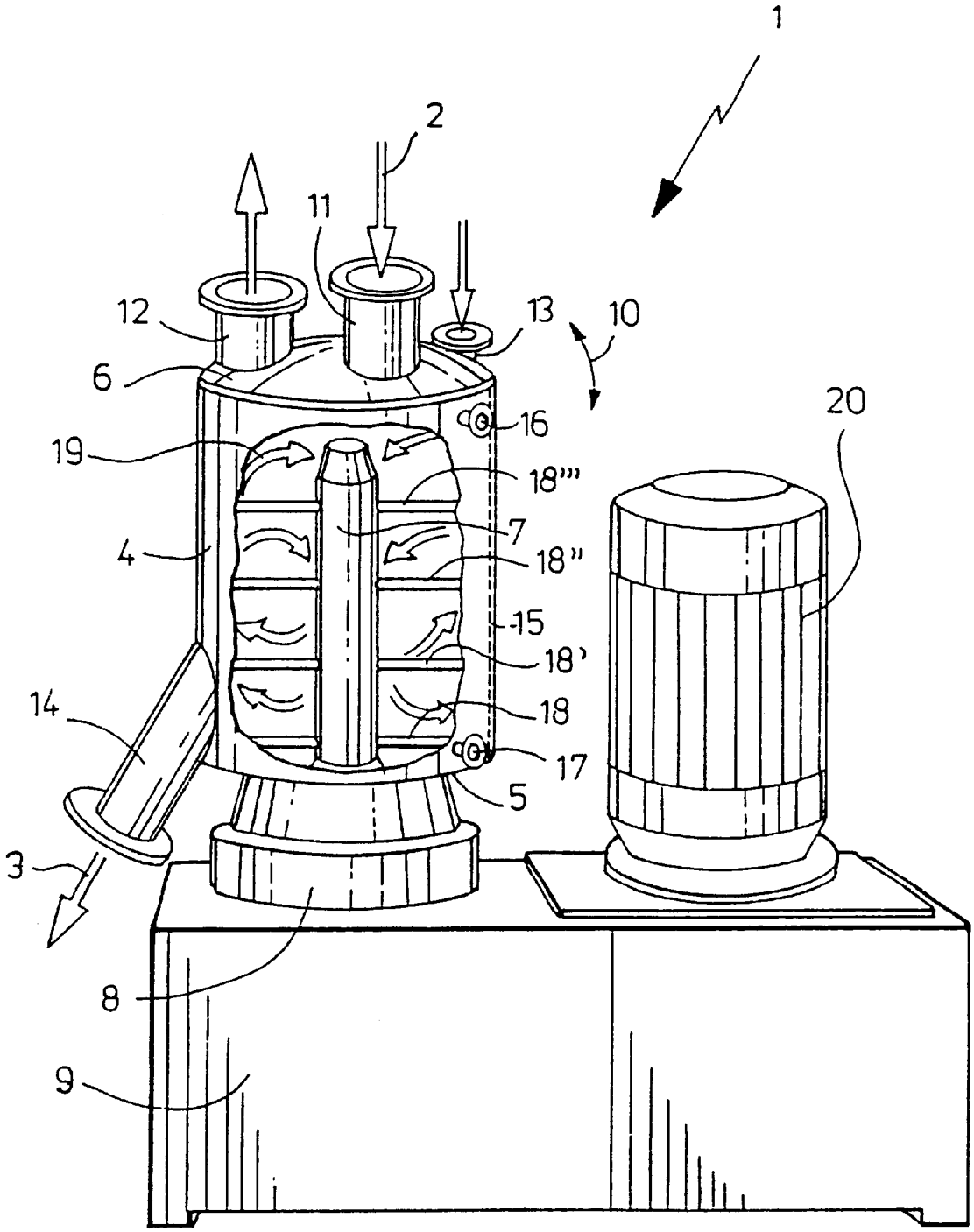
FIG. 1 shows a side view of a mixing container having rapidly rotating mixing elements for producing an intermediate product capable of injection moulding.

FIG. 1 shows the invention in such a fashion that the important features of the invention can be easily recognized. The illustration is not necessarily to be taken to scale.

A device 1 for carrying out a method to produce an intermediate product capable of injection moulding from raw materials and at least one binding agent has a vertically disposed mixing container 4 having an inlet direction 2 and an outlet direction 3. The raw materials and the at least one binding agent can be introduced into the mixing container 4 in inlet direction 2. The produced intermediate product can then leave the mixing container 4 in the outlet direction 3. The raw materials can be stored in the mixing container 4 prior to starting the processing. If the binding agent fraction is high, a portion of the binding agent can be added at a later time. The raw materials can also be added at a later time to influence the mixture comprising the raw material and the binding agent.

The mixture 4 has a floor 5 and a ceiling 6. A shaft 7, capable of rotation, is disposed in the mixing container 4 which penetrates through a bearing 8 in the floor region. The bearing 8 is flanged on one side to the mixing container 4 and at the other side to the machine stand 9. The lid 6, which can be sealed with respect to gas and product, can be pivoted in the direction of arrow 10. A product input chute 11, a gas output chute 12 and a liquid inlet chute 13 are disposed on lid 6. A product output chute 14 is disposed in the vicinity of the floor. The mixing container 4 also has a double jacket 15 connected to chutes 16, and 17 and surrounding the side walls of the mixing container 4. The double jacket 15 can optionally be used to control the temperature of the mixing volume or the cooling of the intermediate product produced using fluids flowing via the chutes 16, 17 into the double jacket 15.

Exemplary mixing elements 18 through 18''' are disposed on the shaft 6 for processing the multi-component mixtures comprising raw materials and binding agent located in the mixing container 4.

When the shaft 7 is driven by a motor 20, preferentially an electrical motor, the mixture comprising the raw materials and at least one binding agent are initially pre-mixed and homogenized. The product located in the mixing container 4 is driven in the direction of arrow 19 through rotation of the shaft 7. The shaft 7 rotates with a high rate of angular revolution so that the mixture within the mixing container 4 can generate a material swirl or a ring of mixed product. The rapid rotation of the shaft 7 can lead to the transfer of frictional heat between the mixing elements 18 through 18''' and the raw material particles and/or the binding agent particles. The surfaces of the binding agent particles can thereby be melted to form an agglomerate together with the raw material particles. The agglomerate can be removed from the mixing container 4 in the form of an intermediate product capable of injection moulding.

The binding agent can be heated-up within the mixing container 4 through the action of the mixing elements 18 through 18'''in such a fashion that the melting point of the binding agent can be reached. In this case, a flow capable paste is produced in the mixing container 4 through a close binding of the raw material particles among themselves and with the binding agent particles. Rotational motion of the shaft 7 can lead to an energy transfer of 0.5 to 1.5 KW/(kg mixing product). The rate of rotation of the shaft 7 can be continuously regulated through control of the motor 20. The produced paste can also be removed from the mixing container 4 via the product output chute 14 in the outlet direction 3.

Alternatively, the produced paste can be cooled within the mixing container 4 with the assistance of the double jacket 15 configured as a cooling jacket so that an agglomerate can be extracted from the paste. The agglomerate can then be appropriately extracted from the mixing container 4 and further processed.

Additional components can be provided for in the upper region of the mixing container for use as additional venting chutes, inlet chutes and/or internal component structures.

A method for the manufacture of an intermediate product, which can be injection moulded, from dry, pasty or fluid raw materials and at least one binding agent can be carried out in a mixing container 4. The raw materials and the at least one binding agent are initially processed into a pourable powder mixture using rapidly rotating mixing elements 18 through 18''', the mixture subsequently being warmed-up and processed into the intermediate product with the assistance of the mechanical processing of the powder mixture by the mixing elements 18 through 18''' and/or the additional components. The method facilitates as effective a manufacture as possible of a high quality intermediate product in a substantially reduced processing time, which can be injection-moulded.

Figure 2:
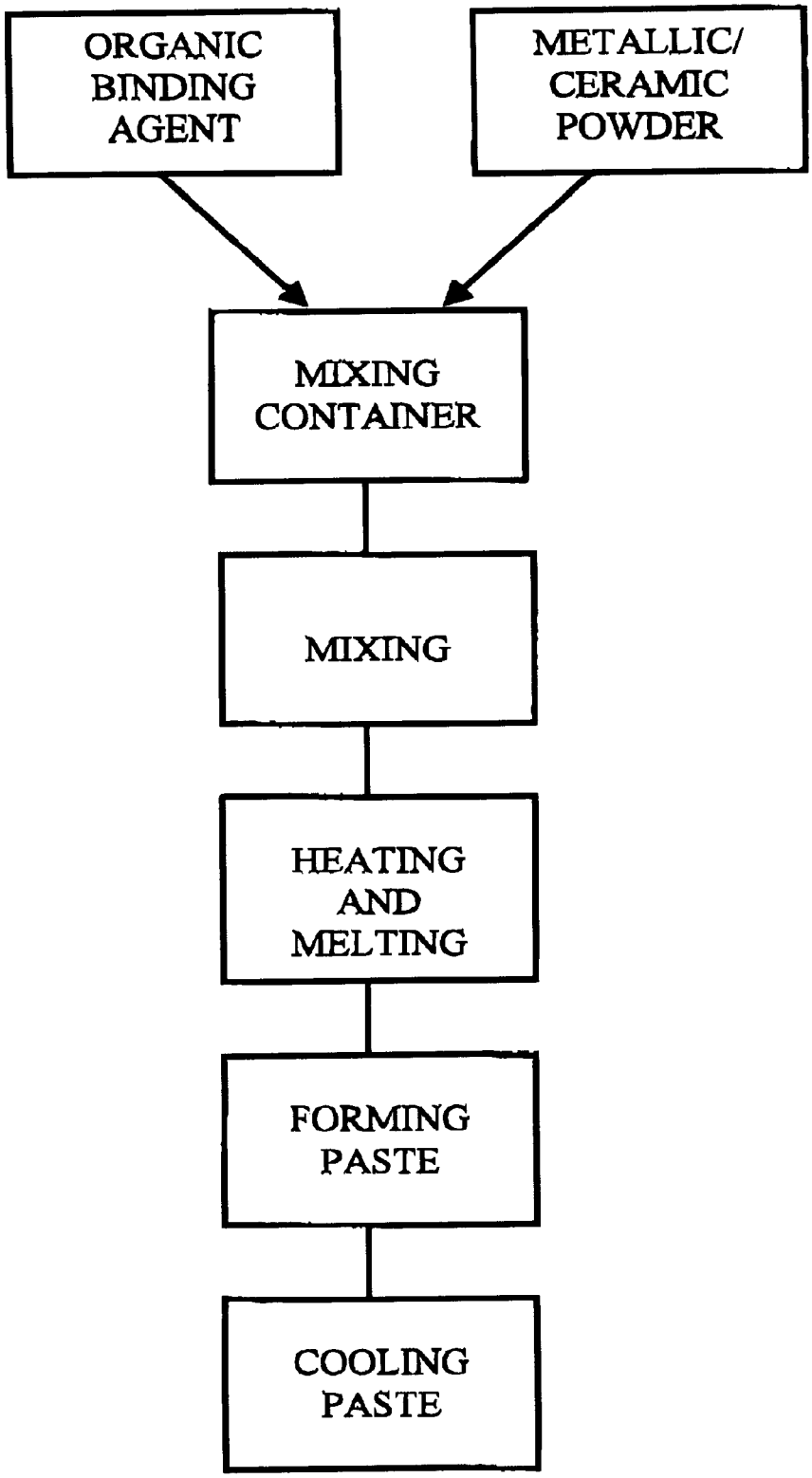
FIG. 2 shows a flow chart of the method in accordance with the invention.

FIG. 2 schematically shows a flow chart illustrating the principal method steps in accordance with the invention. An organic binding agent and a metal or a ceramic powder are combined as a raw material in the mixing container. Mixing elements are used to mix this raw material mixture to produce a mixed powder. Continued mechanical processing of this powder mixture using the mixing elements is then performed. The mixing elements are driven with a peripheral velocity in excess of 20 m/sec to produce a circulating ring of raw material in the mixing container. The raw material mixture is thereby heated and melted and the binding agent is melted by means of this mechanical processing to produce a paste. The paste is appropriate for injection molding and can be injection molded following cooling.

We claim:

1. A method for the manufacture of an intermediate product, which can be injection molded, in a mixing container having rapidly rotating mixing elements, the method comprising;

a) combining one of a metallic and a ceramic powder raw material with at least one organic binding agent to produce a raw material mixture;

b) mixing said raw material mixture in the mixing container using the mixing elements to produce a powder mixture; and c) mechanically processing said powder mixture using the mixing elements, the mixing elements having a peripheral velocity in excess of 20 m/sec to produce a circulating ring of said raw material mixture in the mixing container and to heat and melt said binding agent through mechanical processing to produce a paste which can be injection molded.

2. The method of claim 1, further comprising the step of cooling down said paste in the mixing container to agglomerate said paste.

* * * * *

UNITED STATES PATENT AND TRADEMARK OFFICE

CERTIFICATE OF CORRECTION

PATENT NO. : 6,234,660 B1 
DATED : May 22, 2001
INVENTOR(S) : Hans-Dieter Hullmann, Ulrich Schaer, Ludger Schuermann, Burkhard Wulf It is certified that error appears in the above-identified patent and that said Letters Patent is hereby corrected as shown below:

Title page,
Item [73], Assignee, please replace "Assignee: Gebrueder Loedige Maschinen-gesellschaft mit beschraenkter Haftung, Paderborn (DE)" with
-- Assignee: Gebrueder Loedige Maschinenbau-Gesellschaft mit beschraenkter Haftung, Paderborn (DE) --.

Signed and Sealed this

First Day of January, 2002

*Attest:*

*Attesting Officer*

JAMES E. ROGAN
*Director of the United States Patent and Trademark Office*